US007505374B2

(12) United States Patent
Booty, Jr. et al.

(10) Patent No.: US 7,505,374 B2
(45) Date of Patent: Mar. 17, 2009

(54) ELECTRONIC TIME KEEPING APPARATUS

(75) Inventors: Donald J. Booty, Jr., Cave Creek, AZ (US); Linda Hodgdon, Troy, MI (US)

(73) Assignee: Linda Q. Hodgdon, Troy, MI (US)

( * ) Notice: Subject to any disclaimer, the term of this patent is extended or adjusted under 35 U.S.C. 154(b) by 0 days.

(21) Appl. No.: 11/526,270

(22) Filed: Sep. 22, 2006

(65) Prior Publication Data

US 2007/0070822 A1 Mar. 29, 2007

Related U.S. Application Data

(60) Provisional application No. 60/720,769, filed on Sep. 26, 2005.

(51) Int. Cl.
*G04B 19/00* (2006.01)

(52) U.S. Cl. ..... 368/223; 368/232; 368/239

(58) Field of Classification Search ..... 368/223
See application file for complete search history.

(56) References Cited

U.S. PATENT DOCUMENTS

| | | | | | |
|---|---|---|---|---|---|
| 3,003,305 | A * | 10/1961 | Goldman | ..... | 368/240 |
| 4,280,209 | A * | 7/1981 | Mooney | ..... | 368/71 |
| 5,410,520 | A * | 4/1995 | Stampfer | ..... | 368/240 |
| 5,619,477 | A * | 4/1997 | Schenk | ..... | 368/10 |
| 6,198,698 | B1 * | 3/2001 | Graves | ..... | 368/82 |
| 6,466,517 | B1 * | 10/2002 | Kohl | ..... | 368/28 |
| 6,903,784 | B1 * | 6/2005 | Basturk | ..... | 349/2 |
| 7,050,358 | B2 * | 5/2006 | Garay et al. | ..... | 368/67 |
| 2006/0209637 | A1 * | 9/2006 | May et al. | ..... | 368/223 |
| 2007/0121426 | A1 * | 5/2007 | Simonian et al. | ..... | 368/100 |

* cited by examiner

*Primary Examiner*—Edwin A. Leon
*Assistant Examiner*—Thanh S Phan
(74) *Attorney, Agent, or Firm*—Tod R. Nissle, P.C.

(57) ABSTRACT

An electronic clock that produces both an analog and digital display and includes tracks that sequentially light to indicate passing seconds, minutes, and hours.

1 Claim, 9 Drawing Sheets

ELECTRONIC TIME KEEPING APPARATUS

This application claims priority based on Provisional Patent Application No. 60/720,769, filed Sep. 26, 2005.

This invention relates to time keeping instruments including clocks, watches, and timers.

More particularly, the invention relates to an integrated electronic clock and timer that produces circumferential, analog time-of-day displays on the face of the clock or watch.

Digital clocks represent in numerical integer form the time-of-day, i.e., at ten minutes after eight o'clock in the morning, a digital clock displays 8:10. Similarly, digital timers represent in numerical integer form the precise moment of time remaining, or time accumulated (e.g., race timer).

Analog clocks consist of a display that includes a plurality of hands and a plurality of circumferentially placed symbols indicating hours of the day. The circumferentially placed symbols may, for example, consist of the numerals 1, 2, 3, 4, 5, 6, 7, 8, 9, 10, 11, 12 arrange circumferentially in sequential order. Analog timers, of which there are several mechanical and electromechanical types, often incorporate a rotating dial or dial component to display the time remaining or accumulated. Circumferentially placed symbols typically comprise a beginning and end numeral, and ticks or marks that generally indicate minutes.

In other instances, an analog clock face does not include numerals and only includes "ticks" or marks. Such a "numberless" analog clock may have ticks or marks at the twelve o'clock, three o'clock, six o'clock, and nine o'clock positions on the face of the clock. Some aesthetically modern clocks only display a single indicia for the 12 o'clock position—or no indicia at all. Generally, analog timers display at least one indicia, or two or more indicia, as their function is more utilitarian than decorative.

The disadvantage of a digital clock is that it is restricted to showing the current time in digital form. It does not represent the number of hours in a day. It does not enable a user to visually ascertain the amount of time elapsed from a starting point, or the amount of time remaining until a future time is reached. It does not enable ready visual correlation of seconds to minutes to hours. Similarly, a digital timers only represents the current time remaining, or accumulated—without the contextual reference to start or stop times.

In contrast, an analog clock visually represents the seconds, minutes, and hours in a day; it does enable a user to visually determine time elapsed and to see the relationship between seconds, minutes, and hours. This is particularly useful to an individual learning to tell time and in other circumstances where it is useful to visually gauge the amount of time elapsed or time remaining. Similarly, analog timers visually represent all the time that constitutes the event which is being timed—either the time elapsed, present, and remaining (i.e., countdown timer); or the time accumulated, present and potentially remaining (i.e., count-up timer).

However, digital clocks are almost always more precise in terms of time-keeping and display than analog clocks. Similarly, digital timers are almost always more precise in terms of time-marking and display than analog timers.

Analog clocks are plentiful, as are digital clocks. Systems which can readily present analog and digital displays on a single clock do not appear to be readily available. Nor are systems which integrate both clock and timer functions in a single time-keeping apparatus.

Accordingly, it would be highly desirable to provide an improved clock or watch that would facilitate the use of analog and digital clock displays, analog and digital timer displays and functions, and the integration of these two different modes (or formats) of time-keeping.

Therefore, it is a principal object of the invention to provide an improved time-keeping device.

A further object of the invention is to provide an integrated, electronic clock and timer that can be utilized to produce correlating analog and digital displays for these two modes (or formats) of time-keeping.

These and other, further and more specific objects and advantages of the inventions will be apparent to those skilled in the art from the following detailed description thereof, taken in conjunction with the drawings, in which.

Briefly, in accordance with my invention, we provide an improved, integrated electronic clock and timer. The apparatus comprises a housing; a face mounted in the housing; an electronic control unit mounted in the housing and operatively associated with the face to produce an analog and digital clock display, and analog and digital timer display. The electronic control unit can produce a digital display on the face simultaneously with the analog display such that the analog display and the digital display continuously show the same time. The analog clock display can sequentially cumulatively show in a selected color of light for a selected period of time the time that has passed in at least one of a group consisting of seconds, minutes, and hours.

Figure 1:
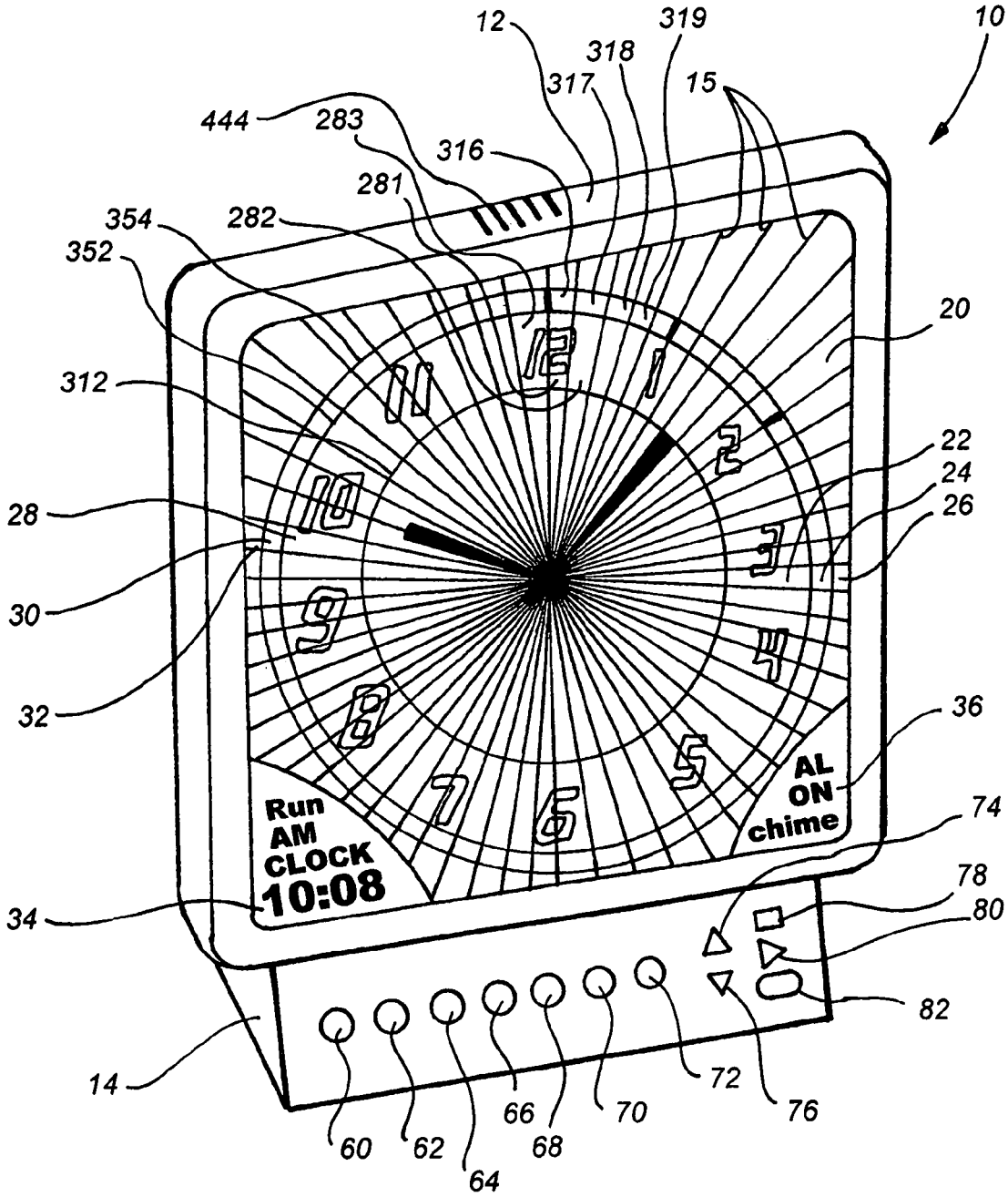
FIG. 1 is a perspective view illustrating the clock mode in accordance with the invention.

Turning now to the drawings, which depict the invention for purposes of explanation and not by way of limitation of the invention, and in which like reference characters refer to corresponding elements throughout the several views, in FIG. 1 integrated electronic clock and timer 10 includes housing 12 and base 14, shown in clock mode. Face 20 is mounted in housing 12 and is shown with an analog clock display. Function control keys 60 to 82 are mounted in housing 12. Face 20 is divided into two or more concentric sections 22, 24, 26 by circles 354, 352, 312. Each concentric section is further divided by sixty radial lines 15 into separate areas, such as, for example, areas 28, 30, 32. Lines 15 emanate from the center of face 20. The angle between an adjacent pair of lines 15 is six degrees, the same measure of arc found between minutes or second markers on a standard analog clock or watch dial. Each pair of adjacent lines bound and define a pie-shaped triangular area.

On face 20, each individual area 320 to 323 outside circle 354 and bounded by a portion of a pair of adjacent lines 15 represents a second in the outer concentric section; each individual area 316 to 319 between circles 354 and 352 and bounded by a portion of a pair of adjacent lines 15 represents a minute; and, each individual area 281 to 283 between circles 352 and 312 and bounded by a portion of a pair of adjacent lines 15 represents an hour.

Readout 34 on the lower left of face 20 indicates the digital time (10:08), the mode (clock or timer) and specific operation function (e.g., clock run, set, etc.). This provides visual feedback for an instructor's used in understanding the operation of the apparatus. Importantly, it also facilitates helping an individual's learning to tell time because the individual can compare the digital time on face 20 with the like time indicated by the adjacent analog display on face 20. The digital time helps an individual read the analog display and identify the hour hand and the minute hand. If the digital time includes seconds, it can also help an individual identify the seconds hand (if there is one) on an analog clock face display or to identify a seconds cursor (if there is one) moving circumferentially around the clock face.

Inset readout 36 on the lower right of face 20 show the alarm on/off, and alarm type (buzzer, voice, chime, music, etc.) selection. The control function buttons on the base 14 of the clock 10 include, from right to left, on-off 60, clock mode start/stop 62, time set 64, hour set 66, minute set 68, second set 70, timer mode/start/stop 72, timer count-up 74, timer count-down 76, alarm on/off, alarm type scroll 80, and alarm selection 82. Any desired function buttons can be utilized.

The pre-recorded and/or digitally created alarm type selections are incorporated in the apparatus electronics and accessed through alarm type scroll button 80. These alarm types can include, without limitation, buzzer, voice, chime, music, and "pre-alarm to alarm" music such as "giddy-up, hurry-up music" that stops when the time stops. Other music selections can also be utilized, such as those typically found on mobile phones and other electronic devices.

The reader skilled in the art will understand that the above means is but one possible construction of the invention, and that other means are possible within its scope.

Figure 2:
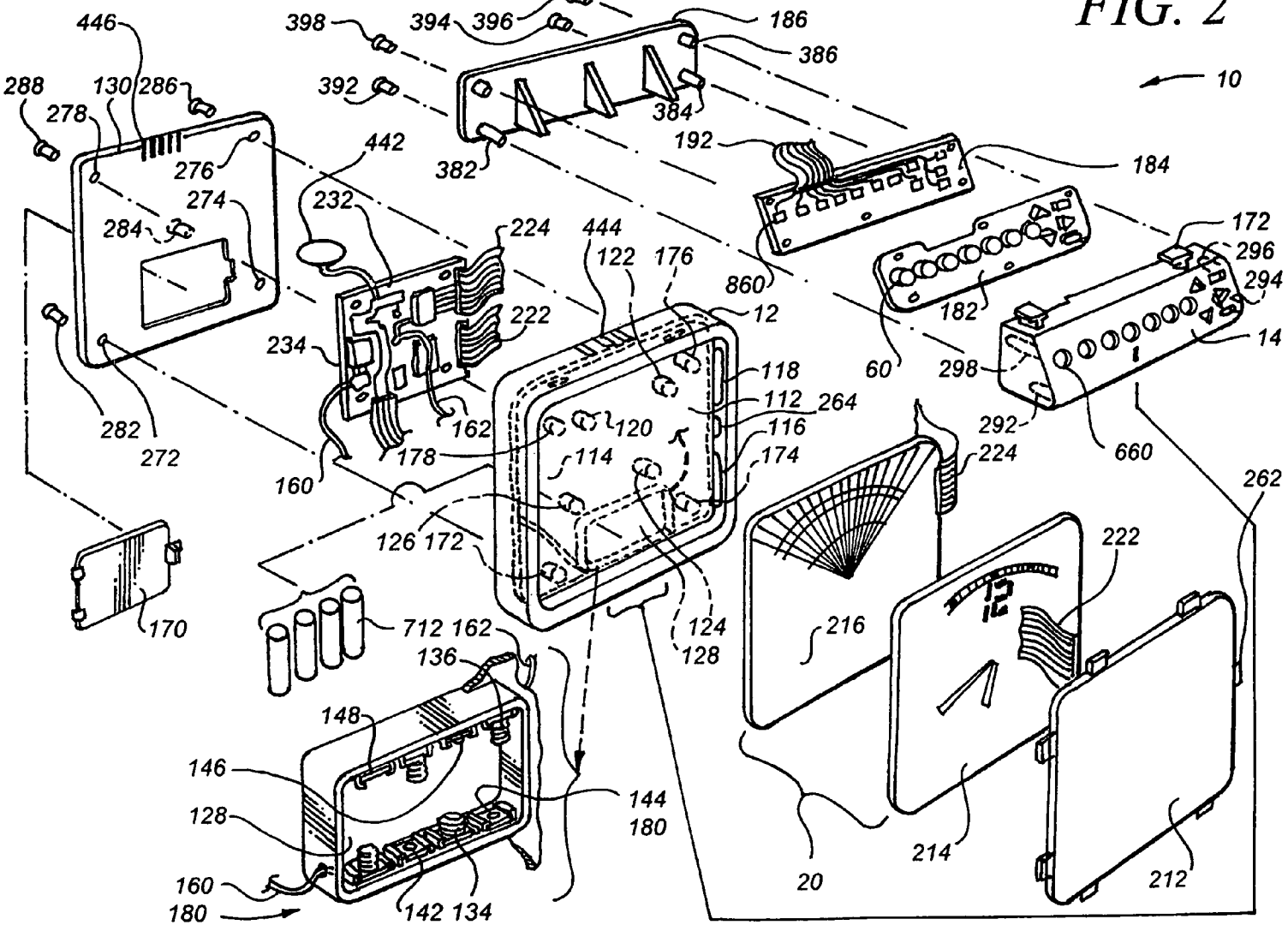
FIG. 2 is an exploded perspective view illustrating the Integrated Electronic Clock and Timer of FIG. 1.

In FIG. 2, integrated electronic clock and timer 10 is shown in exploded view. Housing 12 encloses face 20 and its internal electronics. Clear lens 212 protects face 20. Internally mounted thin LCD display 214, via command of the microprocessor and software driving the clock 10, includes liquid crystal material that forms black opaque sections in selected areas of the display 214 to create electronic representations of an analog clock face including timer hands, display numerals, minute and second tracks, etc. LCD display 214 is also divided into equivalent concentric and radial segments or areas in accordance with the preceding description.

Internally mounted electro-luminescent (EL) display 216 is divided into equivalent concentric and radial segments or areas comparable to or accenting or complementing the concentric and radial segments of LCD display 214. A very low AC electric voltage can be applied to any or multiples ones of and all selected combinations of segments or areas. The electrical voltage excites phosphors and causes illumination of the electro-luminescent coating on each particular segment or area.

EL display 16 is shown in FIG. 2 with partial EL graphics only.

Clear lens 212 assembles into housing 12 by using a plurality of snap-in tabs 262 that each correspond to and fit in a receiving slot 264 in housing 212. Any desired method can be utilized to secure lens 212 in housing 12. Speaker slots 444 are formed through the top of housing 12 to permit sound from a speaker 442 to emanate outwardly through housing 12. Second segments, a minute track, or any other desired portion of an analog clock display or analog or digital time display can, if desired, be silk screened or otherwise formed on the inside or outside of lens 212, or, within lens 212.

Inner facing wall 112 of housing 12 supports mounted LCD and EL displays 214 and 216, respectively. Cable 222 passes through aperture 116. Cable 222 provides circuit connection to the LCD display 214. Cable 224 passes through aperture 118. Cable 224 provides circuit connection to EL display 216.

Cables 222 and 224 are connected at their opposite ends to the integrated circuit (IC) 232 that includes a controller or microprocessor chip, EL display driver, DC-AC converter for the EL driver, one or more speaker(s) 442 for audio of alarms, music, voice and other pre-recorded sounds and other electronic components. Circuit 232 and other electronic components are mounted on printed circuit board (PCB) 234. Board 234 is mounted on the rear facing wall 114 utilizing bosses 120, 122, 124, 126 that are received by apertures formed in PCB 234. The microprocessor or PCB includes a crystal or other means for keeping accurate time, which time is displayed either digitally 43 or in analog form on face 20.

Four-sided battery compartment 128 is connected to wall 114 and is shown in an enlarged view 180. Compartment 128 is shaped to receive one or more batteries 712. In the embodiment of FIG. 2, compartment 128 receives four type AA batteries. Coil spring battery negative contacts 132, 134, 136, 138, and stamped battery positive contacts 142, 144, 146 and 148 receive batteries 712 and form a complete circuit. Wire 160 leads from one end of compartment 128 into IC 232. Another wire 162 from IC 232 lead back to compartment 128.

Back plate 130 includes an opening that corresponds to and fits around the peripheral shape of compartment 128. Plate 130 is fastened to housing 12 with a screw. Battery compartment cover 170 covers compartment 128 and covers the opening that is in plate 130 and that extends around compartment 128. Speaker slots 446 are in alignment with slots 444 on housing 12 to allow sound from one or more speaker(s) to pass from housing 12 through slots 444 and 446.

Assembly of plate 130 and PCB 234 and housing 12 is accomplished by inserting screws 282, 284, 286, 288 through apertures 272, 274, 276, 278, respectively, formed through back plate 130, and, by turning screws 282, 284, 286, 288 into bosses 172, 174, 176, and 178, respectively on housing 12.

FIG. 2 also shows base 14 in exploded view. Base 14 encloses conductive rubber keypad 182. Control function buttons 60-82 are formed integrally with keypad 182. Buttons 60-82 each project through an associated opening in base 14; consequently, button 60 will, when base 14 is assembled, project though opening 660 in base 14. Further, when base 14 is assembled, and button 60 is depressed, button 60 engages tact dome switch 860. Switch 860 is mounted on PCB (printed circuit board) 184. PCB 184 is a component of IC 232. Similarly, when each of the other buttons 62 to 82 are depressed, it contacts a corresponding tact dome switch on PCB 184.

During operation of clock 10, cable 192 routes input commands or signals from keypad 182 to IC 232.

Back plate 186 encloses PCB 184 and keypad 182 in base 14. Back plate 186 is secure by screws 392, 394, 396, 398 which insert through bosses 382, 384, 386, 388, respectively, of back plate 186 and are turned into bosses 292, 294, 296, 298, respectively, of base 14.

The reader skilled in the art will understand that the preceding description of FIG. 2 is but one possible construction of the invention, and that the addition, deletion or substitution of certain components as described would not alter the present invention, nor change its scope.

Figure 3:
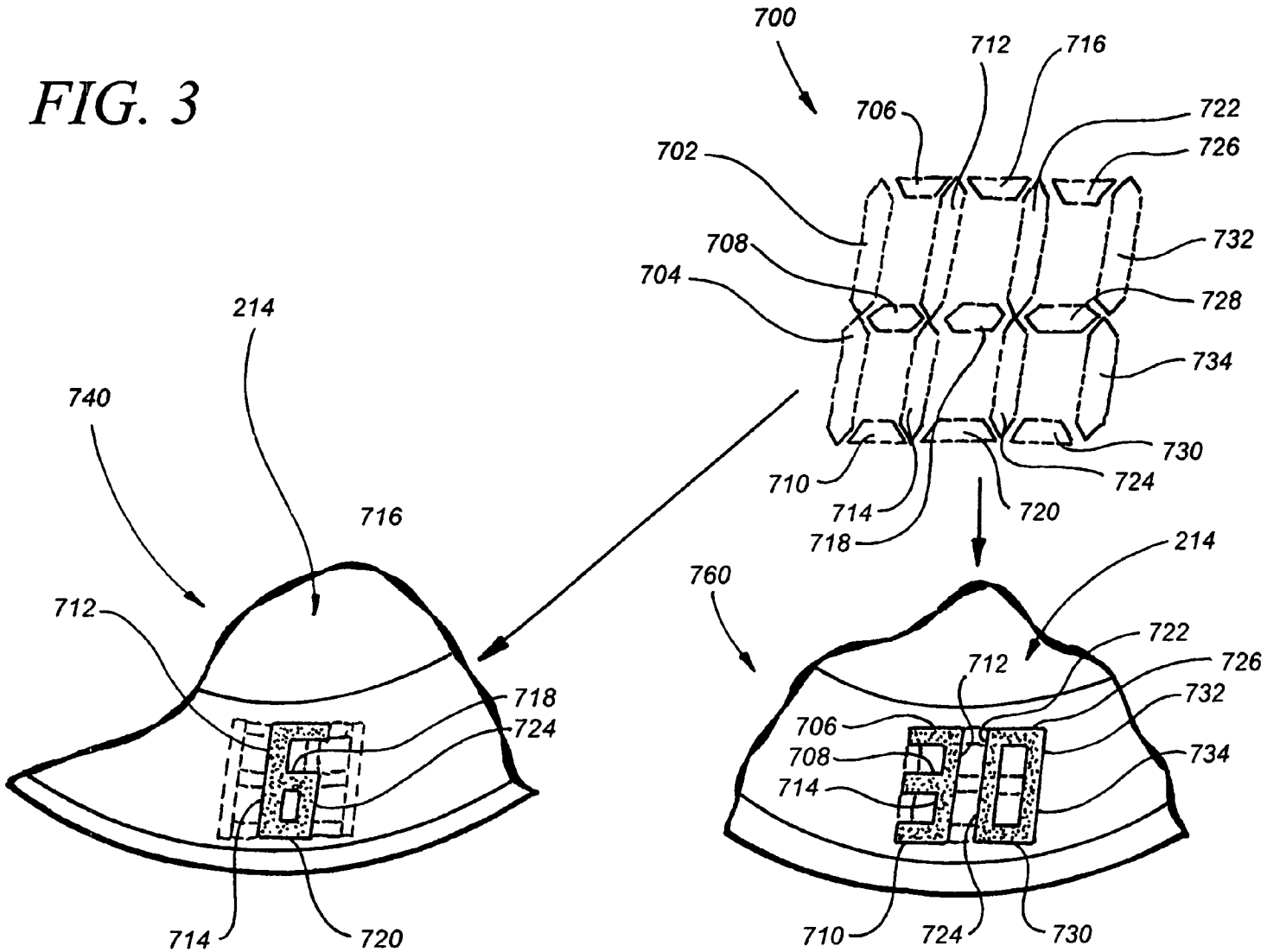
FIG. 3 is an exploded view illustrating the dual use numeral display used in one embodiment of the invention.

In FIG. 3, an alternate embodiment to the preferred embodiment of the LCD dot matrix display is shown. Segment assembly design 700 on display 214 is an example of each segment assembly that is located at positions equivalent to numerals 1 to 12 on a standard analog clock face. There are four rows of vertical segment pairs, numbered top to bottom and right to left as 702, 704, 712, 714, 722, 724, 732, and 734. There are three rows of three horizontal segments, numbered right to left and top to bottom as 706, 708, 710, 716, 718, 720, 726, 728, and 730. This segment assembly design facilitates the display of both single and double digit digital numbers, and, ensures that either type is relatively centered with respect to the corresponding minute and second indicia beginning at 0, 5, 10, etc. In the process of alternating between clock and timer display modes, this segment design is particularly important in the absence of a dot matrix type display.

In segment assembly 740, the segments 712, 714, 716, 718, 720, and 724 combine to form the single digit number six. In segment assembly 760, the segments 706, 708, 710, 712, 714 form the numeral three, and segments 722, 724, 726, 730, 732, and 734 combine to form the numeral zero, which in combination with the numeral three forms the double digit numeral thirty. This segment design should be noted in respect to the clock and timer drawings in FIGS. 4 and 5, respectively, as the segment design of 740 is representative of the digital numerals displayed in clock mode, and the segment design of 760 is representative of the of the digital numerals displayed in the timer mode. As previously mentioned, a segment assembly design that permits single and double digits can be achieved in other ways. In the presently preferred embodiment for the integrated electronic clock and timer, an LCD format based on the grid pattern of an LCD dot matrix display is the most flexible way to achieve this.

Figure 4:
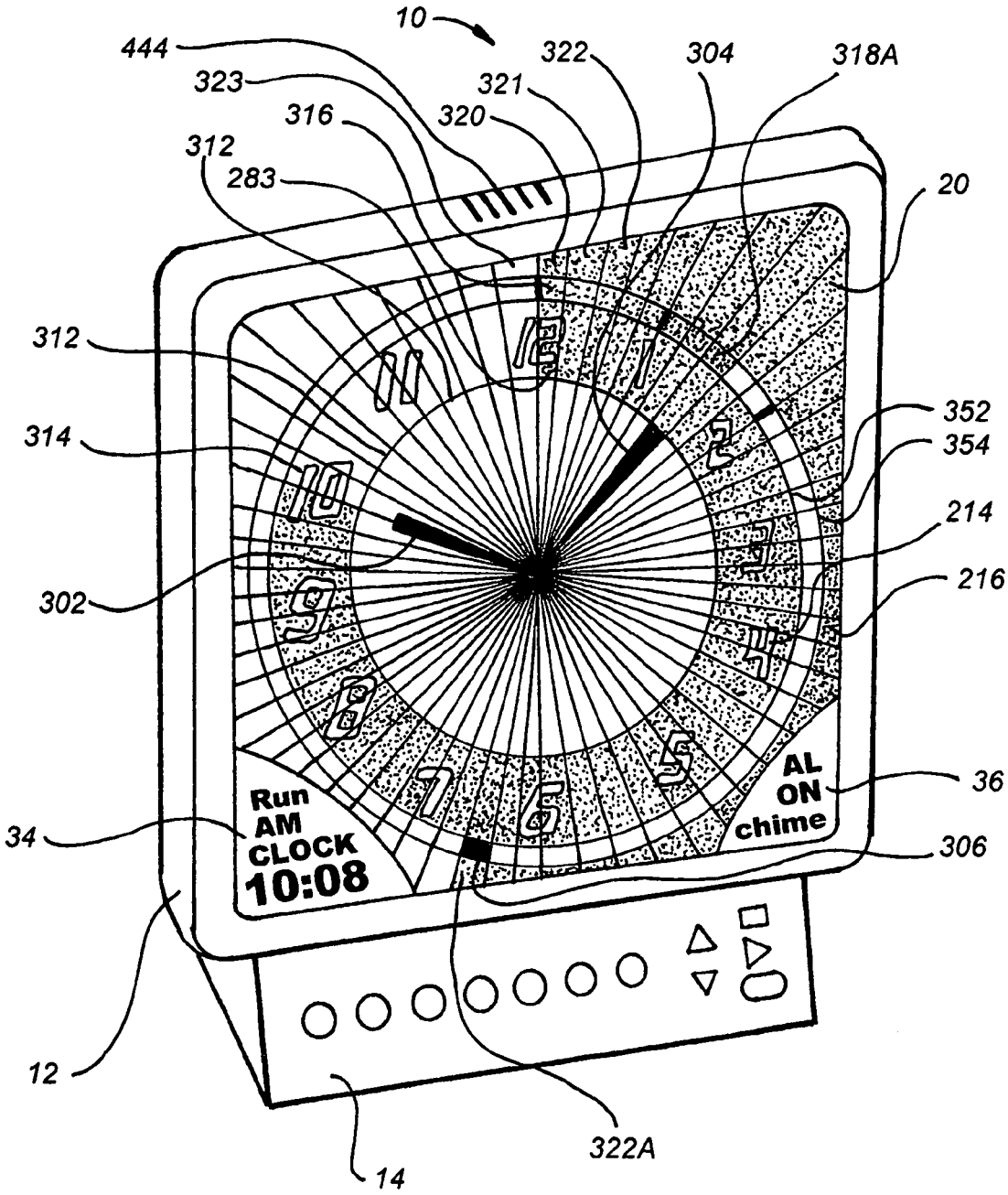
FIG. 4 is a perspective view of the clock of FIG. 1 illustrating the clock mode.

In FIG. 4, face 20 includes an analog clock display. Display 214 depicts standard clock numerals 1 to 12; a digital representation of an analog clock hand 302; a digital representation of a minute clock hand 304; and, a second/minute track intermediate concentric circles 352 and 354 and divided into sixty adjacent areas 316, 352, 306 of equivalent size and circumscribing the central area of face 20. The ones of areas 316 to 319, 352, 306 that are at five second interval positions (i.e., at the hour positions) are darker than the remaining ones of the sixty adjacent areas 316 to 319, 352, 306.

During operation of the clock 10, the passage of seconds is indicated by a "seconds cursor" as areas 316 to 319, 352, 306 sequentially circumferentially brightly light for only a second. At any given second, only a single area 316 to 319, 352, 306 is brightly illuminated, which is why only area 306 is depicted as being illuminated in FIG. 4.

The "second" areas 320, 321, 322 outside circle 354 and extending between and including areas 320 and 318 are stippled, to indicate that they are illuminated. These areas, called the seconds track, when illuminated indicate how many seconds have passed in the current minute being timed by clock 10. Since the seconds cursor is on the thirty-third area, a full thirty-three seconds have passed. The illuminated areas indicated by stippling can have a color the same as or different from the color of the seconds cursor. One area 320 to 322 illuminates each time a second passes. There are a total of sixty areas 302, 321, 322 extending in combination completely around the center of face 20.

The "minute" areas 316 to 319 intermediate circles 352 and 354 and extending between and including areas 321 and 318A are stippled, to indicate that they are illuminated. These areas, called the minutes track, when illuminated indicated how many minutes have passed in the current hour being timed by clock 10. Since there are eight areas 316 to 319 that extend between and include areas 321 and 318A and that are illuminated (stippled) and, since the illuminated areas extend from the twelve o'clock hour to the minute hand, a full eight minutes have passed since the ten o'clock hour. One area 316 to 319 illuminates each time a minute passes. There are a total of sixty areas 316 to 319 extending in combination completely around the center of face 20.

The "hour" areas 281, 283, 282 intermediate circles 283 and 314 and extending between and including areas 283 and 314 are stippled, to indicate that they are illuminated. These areas, called the hours track, when illuminated indicate how many hours have passed in the current hour being timed by clock 10. Since there are fifty areas 281 to 283 that extend between and include areas 283 to 314 and that are illuminated (stippled) and, since the illuminated areas extend from the twelve o'clock hour to ten o'clock, ten full hours have passed since the twelve o'clock hour. One area 281 to 283 illuminates each time twelve minutes passes. There are a total of sixty areas 281 to 283 extending in combination completely around the center of face 20.

The analog clock display need not utilize the seconds track, minutes track, hours track or seconds cursor, and can simply consist of at least one circumferential symbol indicating a particular hour of time, with or without an electronic display of the clock hands. Similarly, when an analog timer display is utilized, it need not utilize a seconds track, minutes track, hours track, or seconds cursor.

Once the minute and hour hands simultaneously reach and point to twelve o'clock, the "second" areas outside circle 354, the "minute" areas between circles 352 and 354, and the "hour" areas between circles 312 and 352 all clear and again begin sequentially illuminating as the minute hand and hour hand move clockwise around face 20. The LCD representations of the minute 304 and hour 302 hands move on face 20 synchronously with the area illuminations. The illumination of the said "second", "minute" and "hour" areas and of the hands 302 and 304 are controlled and operated by the microprocessor on the IC 232.

"Second" areas that illuminate can illuminate in a first color. "Minute" areas that illuminate can illuminate in a second color different from or the same as the first color that is used in the "second" areas. "Hour" areas that illuminate can illuminate in a third color different from or the same as the first and/or second colors. As can be seen in FIG. 4, the number of "second" areas that are illuminated usually is different from the number of "minute" and "hour" areas that are illuminated. This differential in the number of illuminated areas is important because it helps an individual that is learning time to distinguish between seconds, minutes, and hours and to visualize what constitutes a second, a minute, and an hour. Likewise, the use of different colors for the "second", "minute", and "hour" areas facilitates an individual's learning to distinguish between seconds, minutes, and hours; and, helps the individual visualize what constitutes a second, a minute, and an hour.

Figure 5:
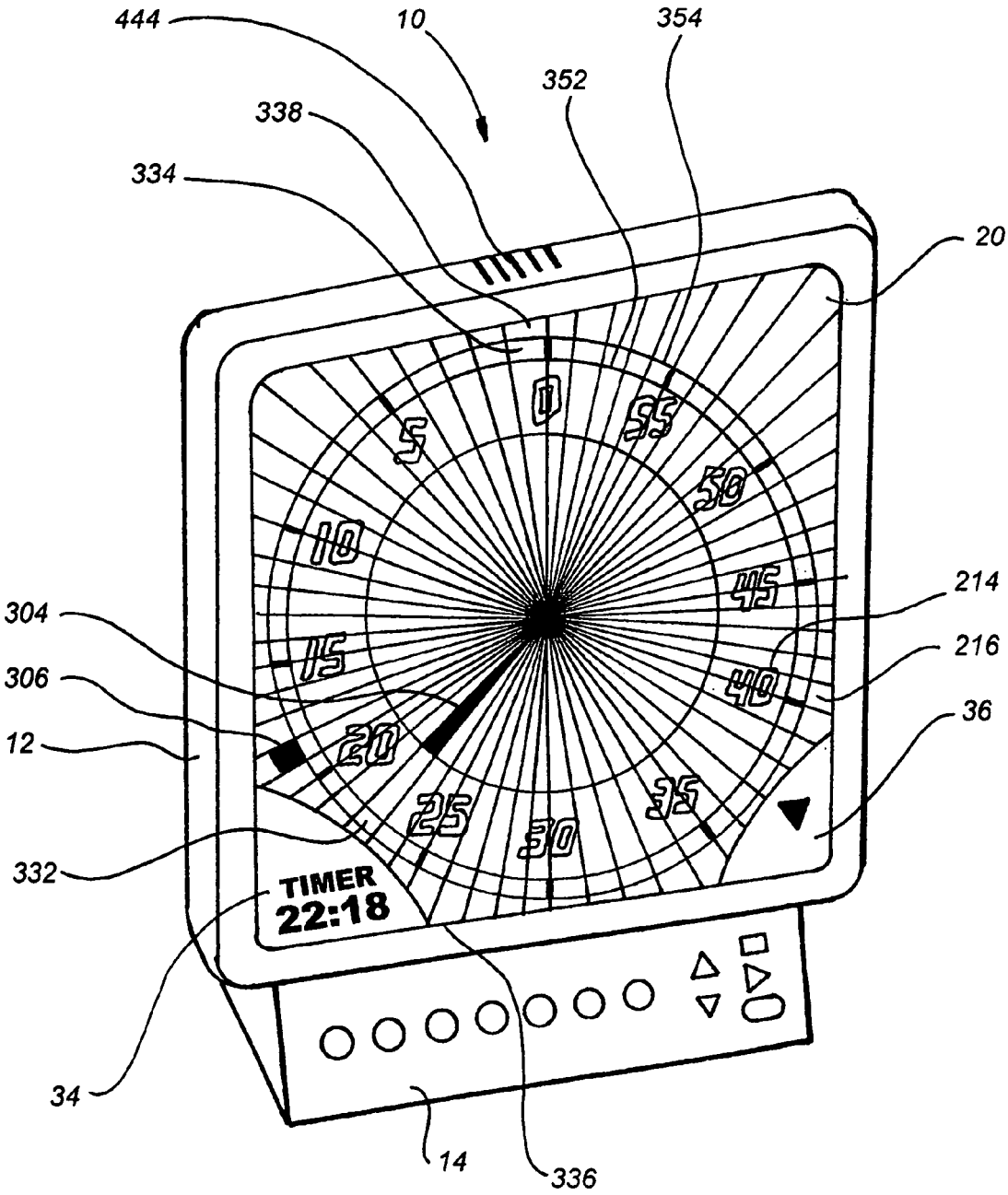
FIG. 5 is a perspective view of the clock of FIG. 1 illustrating the timer mode.

In FIG. 5, integrated electronic clock and timer 10 and face 20 are shown in the timer mode. In the timer mode, the microprocessor causes LCD display 214 to circumferentially present, for example, five minute increments of time adding up to a sixty minute period. However, an almost infinite variety of timer formats could be presented by the electronic apparatus, ranging from one minute increments for a total of five minutes (such as for a child's "time out", when misbehaving) to any other numerical representation possible for a timer. As indicated by hand 304 and seconds cursor 306 and by digital display 34, twenty-two minutes and eighteen seconds have passed on the timer illustrated in FIG. 5. In FIG. 5, hand 304 moves in a counterclockwise direction on face 20.

Alternatively, by using the appropriate timer mode function control button on base 14 of apparatus, an instructor or individual can enter the timer mode while leaving the basic analog display on face 20 that is shown in FIGS. 1 and 4. At the beginning of a six minute time count down, each of the sixty minute areas 281 to 283 that is intermediate circles 312 and 352 is illuminated. After one minute passes, only fifty-nine are illuminated. After two minutes pass, only fifty-eight are illuminated. And so on. If desired, the microprocessor in IC 232 can also make the second areas 316 to 319 illuminate at the beginning of each minute. Since there are a total of sixty of the second areas 316 to 319, one second after a new minute begins there will be fifty-nine of the second areas 316 to 319 illuminated. Two seconds after a new minute begins there will be fifty-eight of the second areas 316 to 319 illuminated, and so on.

Figure 6:
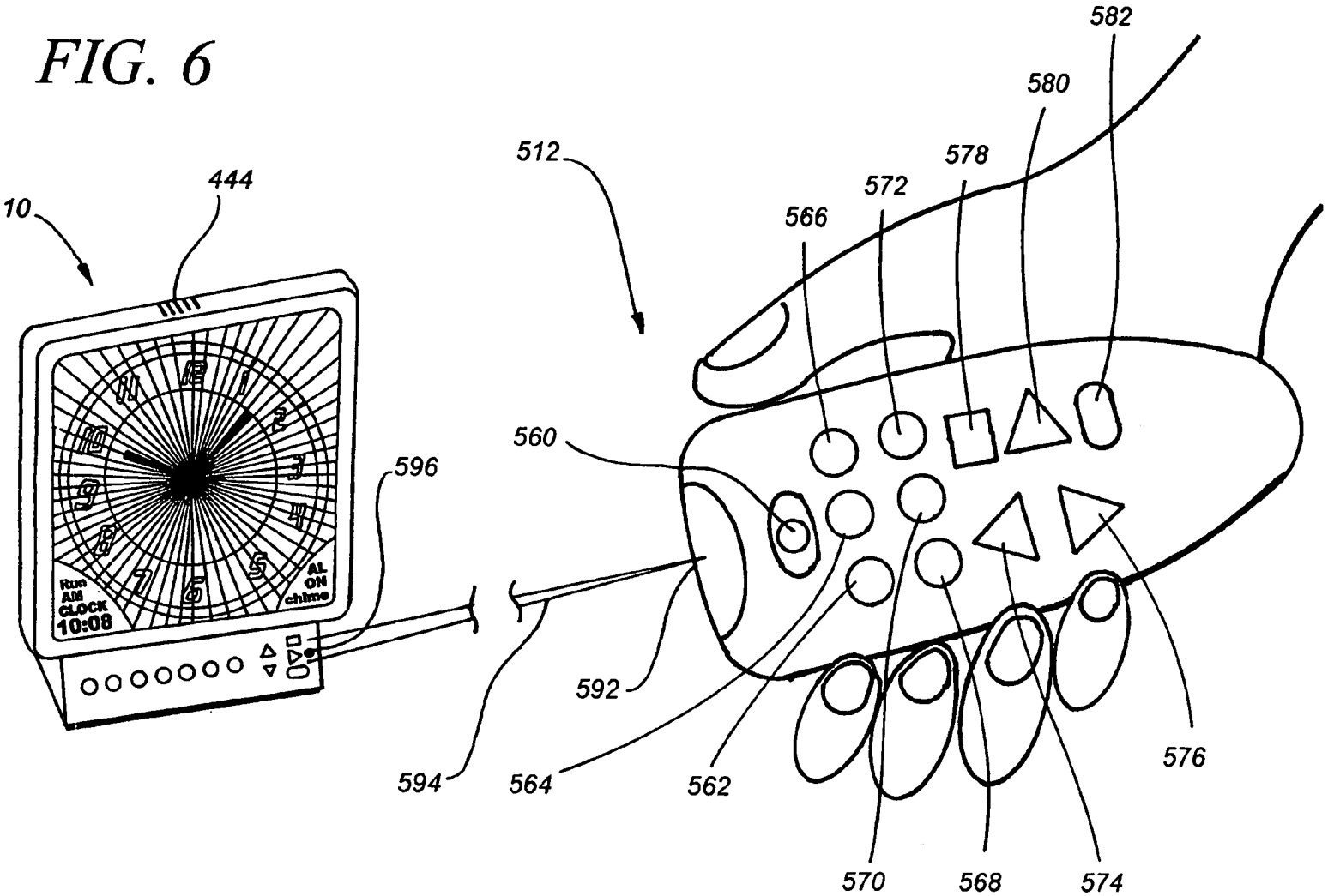
FIG. 6 is a perspective view illustrating the remote control of the Integrated Electronic Clock and Timer of FIG. 1.

FIG. 6 illustrates remote control apparatus for integrated electronic clock and timer 10. Handheld remote control transmitter 512 can use any of a number of wireless or other signal transmission technologies including infrared (IF), and radio frequency (RF). Wireless transmissions can be emitted from section 592 of transmitter 512. In the event infrared transmissions are utilized, transmitter 512 includes an infrared light emitting diode (LED). Infrared radiation emitted from the LED is focused by a plastic lens in transmitter 512 into a narrow beam 594. Beam 594 is modulated and switches on and off to encode data. Receiver 596 on clock 10 receives beam 594. A silicon photo diode in clock 10 converts the infrared radiation to an electric current signal which is received by the microprocessor on IC 232. The microprocessor executes the command contained in the signal.

The function control buttons found on base 14 of clock 10 are duplicated on transmitter 512. Consequently, transmitter 512 includes on-off 560, clock mode/start/stop 562, time set 564, hour set 566, minute set 568, second set 570, timer mode/start/stop 572, timer count-up 574, timer count-down 576, alarm on/off 578, alarm type scroll 580 and alarm selection 582. Any desired means can be used to power transmitter 512. Transmitter 512 is presently preferably powered by one or more batteries.

Transmitter 512 can, if desired, function as a transceiver to both transmit and receive signals from clock 10.

In the timer count up mode, the timer begins at zero and continues until button 572 is utilized to stop the timer. The timer count up mode is utilized by first depressing button 574, and by depressing button 572 to start the timer.

In the timer count down mode, the timer begins at a selected amount of time selected by the user, say fifteen minutes, and then, unless button 572 is utilized to stop the timer, counts down to zero. The timer count down mode is utilized by first depressing button 576, by using buttons 564, 566, 568, 570 and to set the selected period of time, say fifteen minutes (00:15:00), and by depressing button 572 to start the timer.

Pressing button 562 switches the analog display on face 20 from the timer mode to the clock mode, and also switches the digital display from the timer mode to the clock mode.

Figure 7:
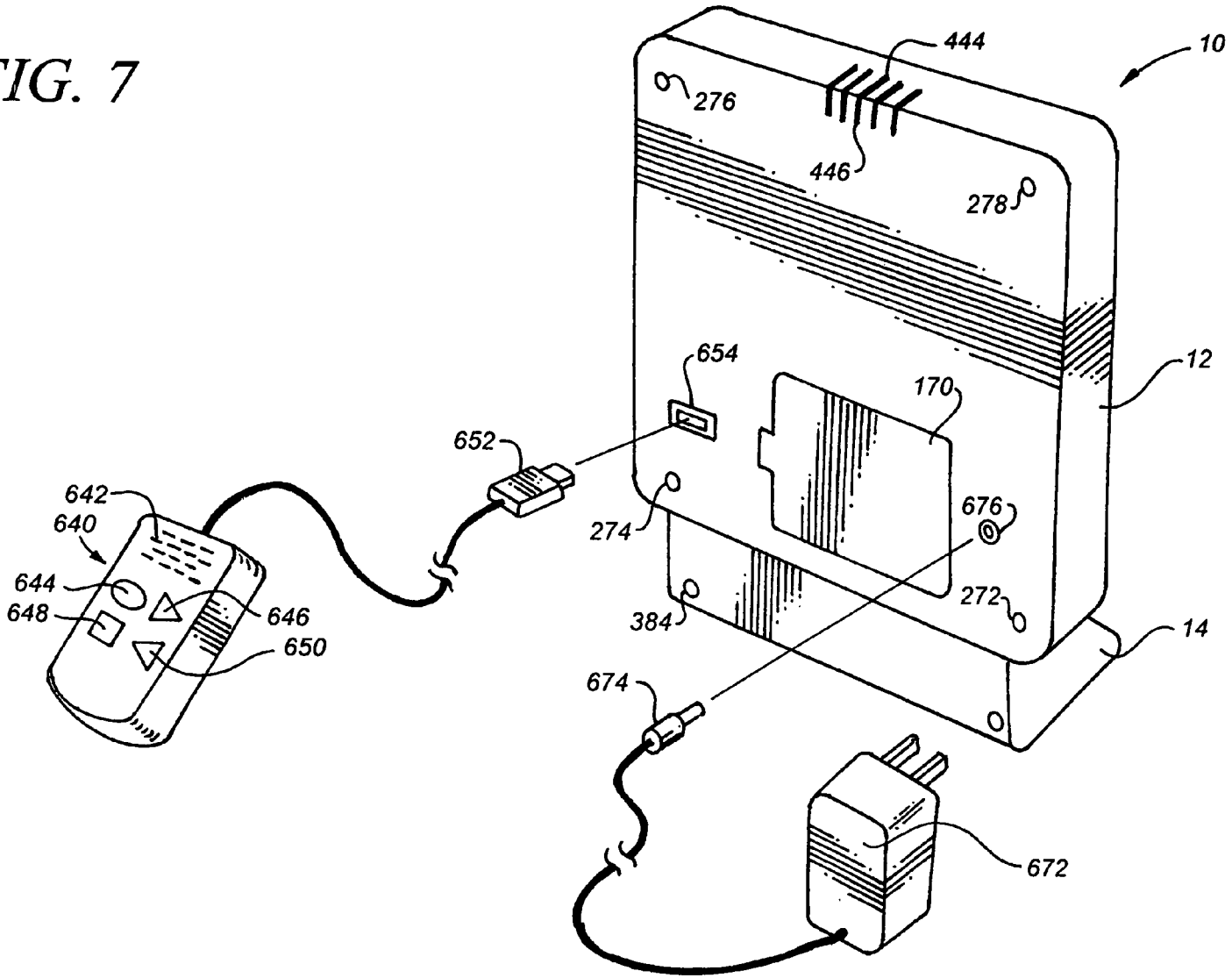
FIG. 7 is a perspective view illustrating further construction details of the Integrated Electronic Clock and Timer of FIG. 1.

In FIG. 7, input device 640 is connected to clock 10 by inserting male connector 652 in serial port 654. Device 640 includes a digital recording function, includes microphone 642; includes control function keys for recording 644, playback 646, and stop 648; and includes at least one input jack 650 such as a USB port. Device 640 permits a user to input their voice, to input music, or to input other sounds that are used in clock 10 for selected functions like an alarm or count-down/count-up/clock features. Direct input into clock 10 can also be accomplished from PCs, laptop computers, PDAs, I-Pods, and other MP3 devices.

Figure 8:
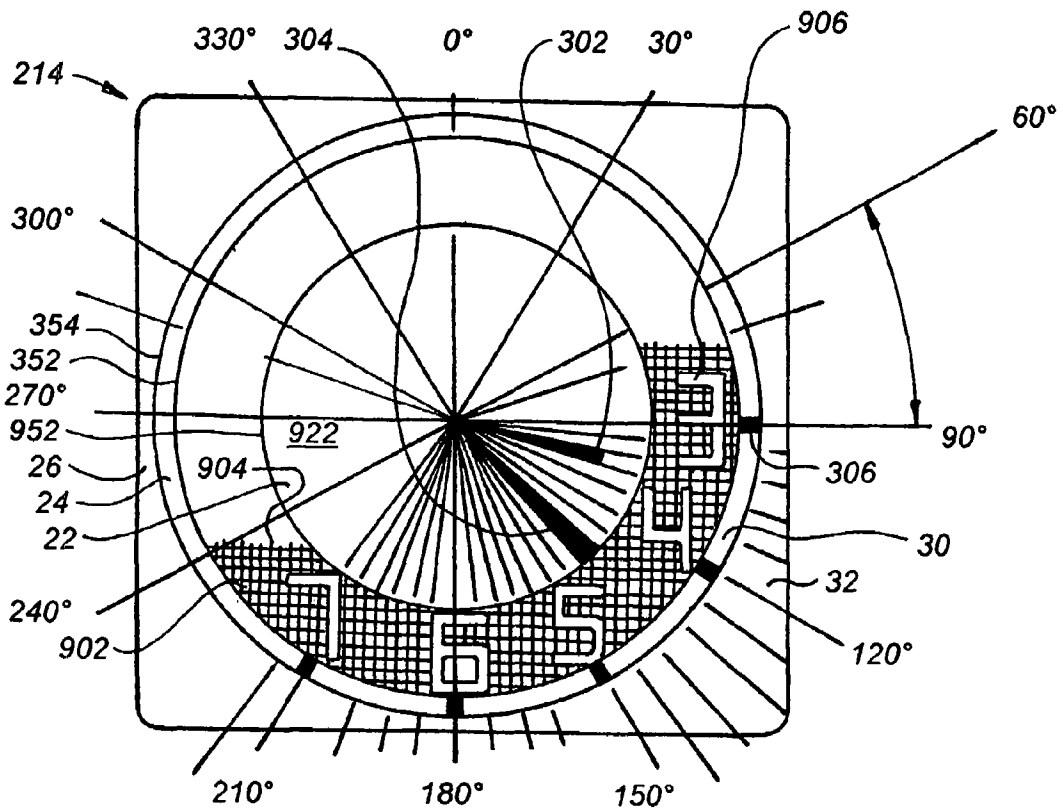
FIG. 8 is a front view of the clock of FIG. 1 illustrating a partial detail of the LCD dot matrix display in the clock mode; and, FIG. 9 is a front view of the clock of FIG. 1 illustrating a partial detail of the LCD dot matrix display in the timer mode.

In FIG. 7, AC-DC adaptor 672 is used to power integrated electronic clock and timer 10. Adaptor 672 includes a cable and male plug-in 674. Plug-in 674 is received by female port or jack 676. An alternate embodiment of LCD display 214 is shown in partial detail in FIG. 8. The portion of display 214 between inner circle 952 and outer circle 352 is defined by the LCD dot matrix display, which is a grid comprised of a series of small LCD on-off squares like square 902. However, it will be understood by the reader that the entire face 20, or any other part or parts thereof, may be comprised of the LCD dot matrix display. Each square 902 is slightly offset from adjacent squares 902, producing spaces 904 intermediate squares 902. In FIG. 8, only a portion of the grid is illustrated, including numerals three 906, four, five, six, and seven on an analog clock face. If a full clock face were illustrated in FIG. 8, then numerals one to twelve would be shown and would be circumferentially located about the center of the face at thirty degree intervals. Consequently, numerals three and four are each centered on a different one of a pair of radial lines that define an angle of thirty degrees. Numerals four and five are each centered on a different one of a pair of radial lines that define an angle of thirty degrees, and so on.

Figure 9:
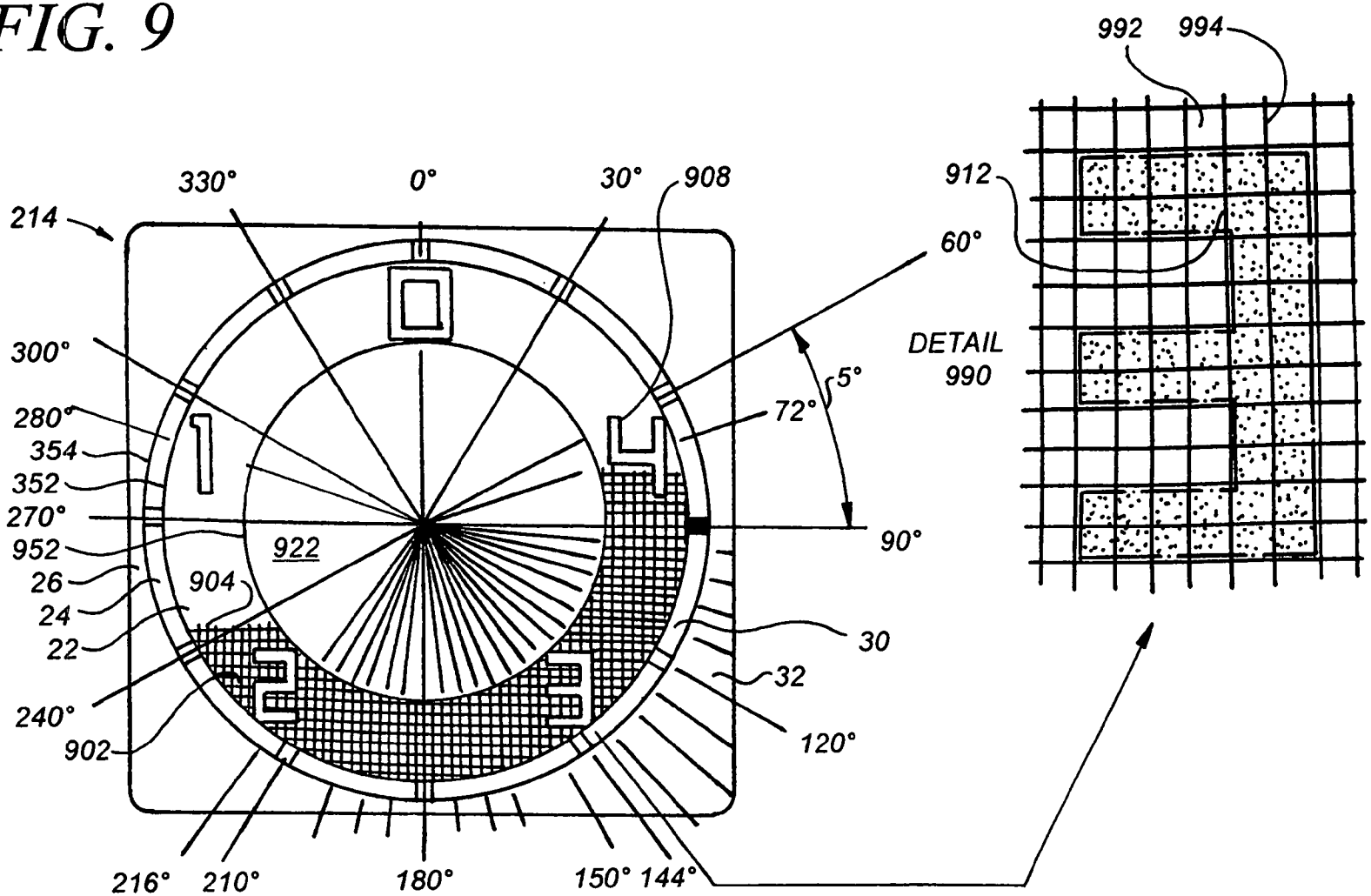

The electronic clock face in FIG. 8 also includes hour 302 and minute 330 hands, includes a minute/second track 30 intermediate concentric circles 352 and 354, and includes an hour track 24 intermediate concentric circles 952 and 352. A partial view of the preferred embodiment, in which the face is comprised of an LCD dot matrix display, is shown in this drawing. Dot matrix displays are formed by adjacent LCD on-off squares, with images formed by turning certain LCD squares on, and some off. The collective image is made dynamic (moving clock hands, etc.) with pre-programming of the microprocessor to create the images that relate to various modes of time-keeping and other functions/operations of the device. Second indicia 306 moves along the track 30 in the same manner as indicia 306 in FIG. 4. The LCD display of FIG. 9 is similar to that of FIG. 8 except that the display comprises equally spaced numerals one, two, three, four 908 instead of the normal clock face numerals one to twelve. Each successive pair of numerals 0,1; 1,2; etc. is spaced apart at a seventy-two degree interval. As indicated by FIGS. 8 and 9, the particular numerals displayed on the face of the electronic clock of the invention can vary as desired.

The exploded view 990 in FIG. 9 illustrates in greater detail the numeral three in the LCD display, which in this drawing represent a five-minute timer display, but which the reader skilled in the art will understand may be a timer display of alternate time length. Spaces 912 are, as discussed above, between adjacent LCD on-off squares, which describes an LCD dot matrix display. The "on" LCD squares 994 form the numeral three while the off LCD square 992 form the display area adjacent the numeral three.

The hands on the face of an analog clock typically include an hour hand and a minute hand, and, can include a second hand. The hands can be made from metal or some other material and pivot about the center of the face of the clock. When, however, the hands are electronically formed on a clock face comprised of LCDs, the hands need not extend from the center of the clock. If the analog clock face has sixty equally spaced circumferential increments or graduation marks indicating minutes, the particular graduation mark indicating the correct second during a minute of time can be lighted, while the other graduation marks are not lighted. As the minutes tick off, other graduation marks are sequentially turned on and off. In this case, the graduation marks each periodically function as a minute hand or minute cursor.

Similarly, each graduation mark can light briefly (and then turn off) to indicate the passage of seconds of time. In this case, the graduation marks each periodically function as a second hand or second cursor.

Finally, each graduation mark located at an hour interval can be lit for a cumulative period of two hours (one hour during the day and one hour at night) to indicate the particular correct hour of time. In this case, the graduation marks each periodically function as an hour hands or hour cursor.

Having described our invention in such terms as to enable those of skill in the art to understand and practice the invention, and having described the presently preferred embodiments thereof, we claim:

1. An integrated electronic timer-clock comprising (A) a housing;

(B) a face mounted in said housing;

(C) an analog display comprising a plurality of circumferentially placed, spaced apart symbols on said face;

(D) at least one hand continuously moving along a circular path past said symbols to indicate one of a group consisting of hours and minutes;

(E) an electronic control unit mounted in said housing and operatively associated with said face to produce said analog display on said face, said control unit having at least two operative modes, (1) a first operative time-of-day mode with a spaced apart first group of circumferentially placed symbols (314) formed on said face, used to indicate the time-of-day and including (a) an hours track with a plurality of radial segments (281, 282, 283) that sequentially cumulatively illuminate or de-illuminate to indicate the hours of time that have passed such that during the majority of times of day a plurality of said radial segments are illuminated and (b) a minutes track concentric with said hours track and with a plurality of radial segments (316, 317, 318, 319) separate from said hours track and that sequentially cumulatively illuminate or de-illuminate to indicate the minutes of time that have passed such that during the majority of times of day (i) a plurality of said radial segments of said minutes track are illuminated, and (ii) a proportion of said minutes track is illuminated that is different from the proportion of said hours track that is illuminated; and (2) a second operative timer mode with a spaced apart second group of circumferentially placed symbols (214, 994) formed on said face, different from and replacing said first group of indicia, and used as a timer to indicate the passage of a selected period of time and not to indicate the time of day, said second group of indicia including a radial track with a plurality of radial segments that sequentially cumulatively illuminate or de-illuminate to indicate time that has passed such that during the greater portion of said selected period of time at least a plurality of said radial segments of said radial track of said second group of indicia are illuminated.

* * * * *